US010587956B2

(12) United States Patent
Hintennach et al.

(10) Patent No.: US 10,587,956 B2
(45) Date of Patent: Mar. 10, 2020

(54) MEMBRANE FOR A LOUD SPEAKER

(71) Applicant: Sound Solutions Austria GmbH, Vienna (AT)

(72) Inventors: Andreas Hintennach, Vienna (AT); Armin Timmerer, Vienna (AT)

(73) Assignee: Sound Solutions Austria GMBH, Vienna (AT)

( * ) Notice: Subject to any disclaimer, the term of this patent is extended or adjusted under 35 U.S.C. 154(b) by 0 days.

(21) Appl. No.: 16/084,727

(22) PCT Filed: Dec. 16, 2016

(86) PCT No.: PCT/EP2016/081510

§ 371 (c)(1),
(2) Date: Sep. 13, 2018

(87) PCT Pub. No.: WO2017/157495

PCT Pub. Date: Sep. 21, 2017

(65) Prior Publication Data

US 2019/0075400 A1 Mar. 7, 2019

Related U.S. Application Data

(60) Provisional application No. 62/309,378, filed on Mar. 16, 2016.

(51) Int. Cl.
*H04R 7/18* (2006.01)
*H04R 7/06* (2006.01)
(Continued)

(52) U.S. Cl.
CPC ..... *H04R 7/18* (2013.01); *H04R 7/06* (2013.01); *H04R 9/06* (2013.01); *H04R 31/003* (2013.01)

(58) Field of Classification Search
CPC ..... H04R 7/20; H04R 31/003; H04R 7/18; H04R 9/06; H04R 7/06; H04R 7/04
(Continued)

(56) References Cited

U.S. PATENT DOCUMENTS 7,931,115 B2 4/2011 Silver
9,913,043 B2 3/2018 Song et al.
(Continued)

FOREIGN PATENT DOCUMENTS

CN 203225873 U 10/2013
CN 203984657 U 12/2014
(Continued)

OTHER PUBLICATIONS

First Office Action dated Jan. 15, 2020 for counterpart Chinese patent application No. 201680083663.1.
(Continued)

*Primary Examiner* — Melur Ramakrishnaiah
(74) *Attorney, Agent, or Firm* — Steven McMahon Zeller; Dykema Gossett PLLC

(57) ABSTRACT

The invention relates to a new membrane for a loudspeaker. The membrane comprises a central portion having a sound emitting surface and a back surface. The membrane further comprises a first edge directly adjacent to the central portion and surrounding the central portion. The membrane further comprises a second edge surrounding the first edge and an intermediate portion located between the first edge and the second edge, wherein the intermediate portion comprises at least one convex shaped section with regard to the sound emitting surface area of the central portion and at least one concave shaped section with regard to the sound emitting surface area of the central portion.

18 Claims, 13 Drawing Sheets

(51) Int. Cl.
*H04R 9/06* (2006.01)
*H04R 31/00* (2006.01)

(58) Field of Classification Search
USPC ..... 381/398, 380, 396, 190, 150, 412, 182, 381/191, 322; 428/212, 213
See application file for complete search history.

(56) References Cited

U.S. PATENT DOCUMENTS

| | | | | |
|---|---|---|---|---|
| 2009/0139794 | A1 | 6/2009 | Silver | |
| 2013/0170687 | A1 | 7/2013 | Papakyriacou et al. | |
| 2014/0119591 | A1* | 5/2014 | Meng | H04R 9/02 381/386 |
| 2015/0136517 | A1* | 5/2015 | Zhu | H04R 7/20 181/153 |
| 2016/0021442 | A1* | 1/2016 | Xu | H04R 9/06 381/412 |
| 2016/0021460 | A1* | 1/2016 | Shi | H04R 9/025 381/398 |

FOREIGN PATENT DOCUMENTS

| | | | | |
|---|---|---|---|---|
| CN | 104519450 | A | 4/2015 | |
| CN | 204887418 | U | 12/2015 | |
| DE | 1277930 | B | 9/1968 | |
| EP | 0556786 | A2 * | 8/1993 | H04R 7/06 |
| EP | 0556786 | A2 | 8/1993 | |
| WO | 2015131821 | A1 | 9/2015 | |

OTHER PUBLICATIONS

Search Report dated Jan. 15, 2020 for counterpart Chinese patent application No. 201680083663.1.

* cited by examiner

MEMBRANE FOR A LOUD SPEAKER

BACKGROUND OF THE INVENTION a. Field of the Invention

The present invention relates to a membrane for a loudspeaker with enhanced acoustic properties. This invention furthermore relates to a micro speaker optimized for high acoustic output and located within a small volume of a mobile device, such as a mobile phone, a tablet, a gaming device, a notebook or similar device.

b. Background Art

Prior art membranes comprise a central portion with a sound emitting surface area and a back surface area located opposite the sound emitting surface area, wherein the sound emitting surface area and the back surface area of the central portion constitute at least 60 percent of the overall surface area of the membrane. The membrane further comprises a first edge directly adjacent to the central portion and surrounding the central portion, wherein the first edge constitutes a boundary line between the central portion and an adjacent area comprising a different surface curvature than the central portion. Furthermore, the membrane comprises a second edge surrounding the first edge, a clamping collar for mounting the membrane to the loudspeaker, wherein the second edge directly merges into the clamping collar and an intermediate portion located between the first edge and the second edge.

CN203225873 U discloses a membrane of the above mentioned kind. The membrane has a rectangular structure, wherein the intermediate portion comprises protrusions for reinforcing the intermediate portion of the membrane.

CN204887418 U relates to a membrane with a central portion and a ring portion, wherein the ring portion comprises ridges protruding from the ring portion.

CN203984657 U discloses s membrane comprising a spherical top in the middle, and a ring part on the outer periphery of the spherical top. The ring part is protruding out of a plane where the spherical top is located and is provided with a plurality of reinforcing protrusions to increase strength of the membrane.

WO15131821 A1 relates to a speaker vibration system comprising a diaphragm body part and a voice coil combined at a lower side of the diaphragm body part. The speaker vibration system comprises a rigid dome part, a silicone rubber membrane and a plastic stent combined at an edge of the silicone rubber membrane. The dome part is arranged at a middle position of the silicone rubber membrane. A ring part is arranged at a position that is located at an outer side of the dome part on the silicone rubber membrane. The ring part is either concave or convex shaped.

DE1277930 B discloses an elliptic membrane with a tubular vibration part surrounded by a ring comprising grooves.

A particular drawback of known membranes are their acoustic properties. It is a further drawback of the known membranes that they require a lot of mounting space, which is a major problem with regard to micro speakers.

SUMMARY OF THE INVENTION

It is an object of the present invention to provide a membrane for a loudspeaker with increased acoustic performance and to reduce total harmonic distortion (THD) of the loud speaker.

It is a further object of the present invention to reduce the required space for the membrane and to allow a more flexible design of the loud speaker.

The present invention may be implemented by the following embodiments.

In accordance with one aspect of the present invention, it provides a membrane for a loudspeaker, wherein the membrane comprises: a central portion comprising a sound emitting surface area and a back surface area located opposite the sound emitting surface area, wherein the sound emitting surface area and the back surface area of the central portion constitute at least 70 percent of the membranes overall surface area; a first edge directly adjacent to the central portion and surrounding the central portion, wherein the first edge constitutes a boundary line between the central portion and an adjacent area comprising a different surface curvature than the central portion; a second edge surrounding the first edge; a clamping collar for mounting the membrane to the loudspeaker, wherein the second edge directly merges into the clamping collar; an intermediate portion located between the first edge and the second edge, wherein the intermediate portion comprises at least one convex shaped section with regard to the sound emitting surface area of the central portion and at least one concave shaped section with regard to the sound emitting surface area of the central portion.

In an embodiment, an area of a top surface of the membrane may lie within a range of 0.4 to 5 $cm^2$.

According to an advantageous embodiment of the invention a cross-section of the convex shaped section along a line normal to the first edge is of a U-shaped form; and wherein a cross-section of the concave shaped section along a line normal to the first edge is of a U-shaped form.

In an embodiment a horizontal position of the central portion the concave shaped section is disposed above the central portion and the convex shaped section is disposed under the central portion.

In a horizontal position of the central portion a distance between a level of a vertex of the convex shaped section and a level of the sound emitting surface may be of the same absolute value like a distance between a vertex of the concave shaped section and the level of the sound emitting surface of the central portion.

The central portion may be disposed between the at least one concave shaped section and the at least one convex shaped section.

Furthermore, the first edge and the second edge each have the shape of a conic section, or a polygon or a tetragon.

The first edge may define a tetragon, such as a rectangle, square or a parallelogram, with rounded corners, and wherein the second edge also defines a tetragon with rounded corners.

In an embodiment, the at least one concave shaped section of the intermediate portion merges into the at least one convex shaped section of the intermediate portion or vice versa viewed in direction of a shortest distance between the edge and the second edge.

According to an embodiment the first edge may comprise a first and a second side running parallel to each other; a third and a fourth side running parallel to each other, wherein the second edge comprises a first and a second side running parallel to each other; a third and a fourth side running parallel to each other, wherein the first side and the second side of the first edge run parallel to the first side and second side of the second edge and the third side and the fourth side of the first edge run parallel to the third side and fourth side of the second edge.

The at least one convex shaped section may be arranged between the first side of the first edge and the first side of the second edge and the at least one concave shaped section may be arranged between the third side of the first edge and the third side of the second edge, said at least one convex shaped section connecting said first side of the first edge to said first side of the second edge and said at least one concave section connecting the third side of the first edge to the third side of the second edge.

The intermediate area of the membrane may comprise a Leporello fold shape within an area located between a rounded corner of the first edge and a rounded corner of the second edge and connecting said rounded corner of the first edge to said rounded corner of the second edge.

A shape of the intermediate portion may change from a concave shape to a convex shape within an area located between a rounded corner of the first edge and a rounded corner of the second edge and connecting said rounded corner of the first edge to said rounded corner of the second edge.

In an embodiment a shape of the intermediate portion may change from a convex-concave shape to a convex or concave shape within an area located between a rounded corner of the first edge and a rounded corner of the second edge and connecting said rounded corner of the first edge to said rounded corner of the second edge.

In a further embodiment a shape of the intermediate portion may change from a convex-concave shape to another convex-concave shape within an area located between a rounded corner of the first edge and a rounded corner of the second area and connecting said rounded corner of the first area to said rounded corner of the second edge. Furthermore, the central portion may have a generally rectangular shape with rounded corners.

In accordance with a further aspect of the present invention, it provides a loudspeaker, comprising: The membrane as described in any of the above embodiments.

With the above aspects, the membrane can provide excellent acoustic properties, since the total harmonic distortion is minimized essentially. Furthermore it is possible to adapt the form of the intermediate portion of the membrane according to a wiring of the loud speaker. For instance, convex shaped parts of the intermediate portions may serve as wire ducts for leads of a coil driving the membrane.

DETAILED DESCRIPTION OF EMBODIMENTS

Figure 1:
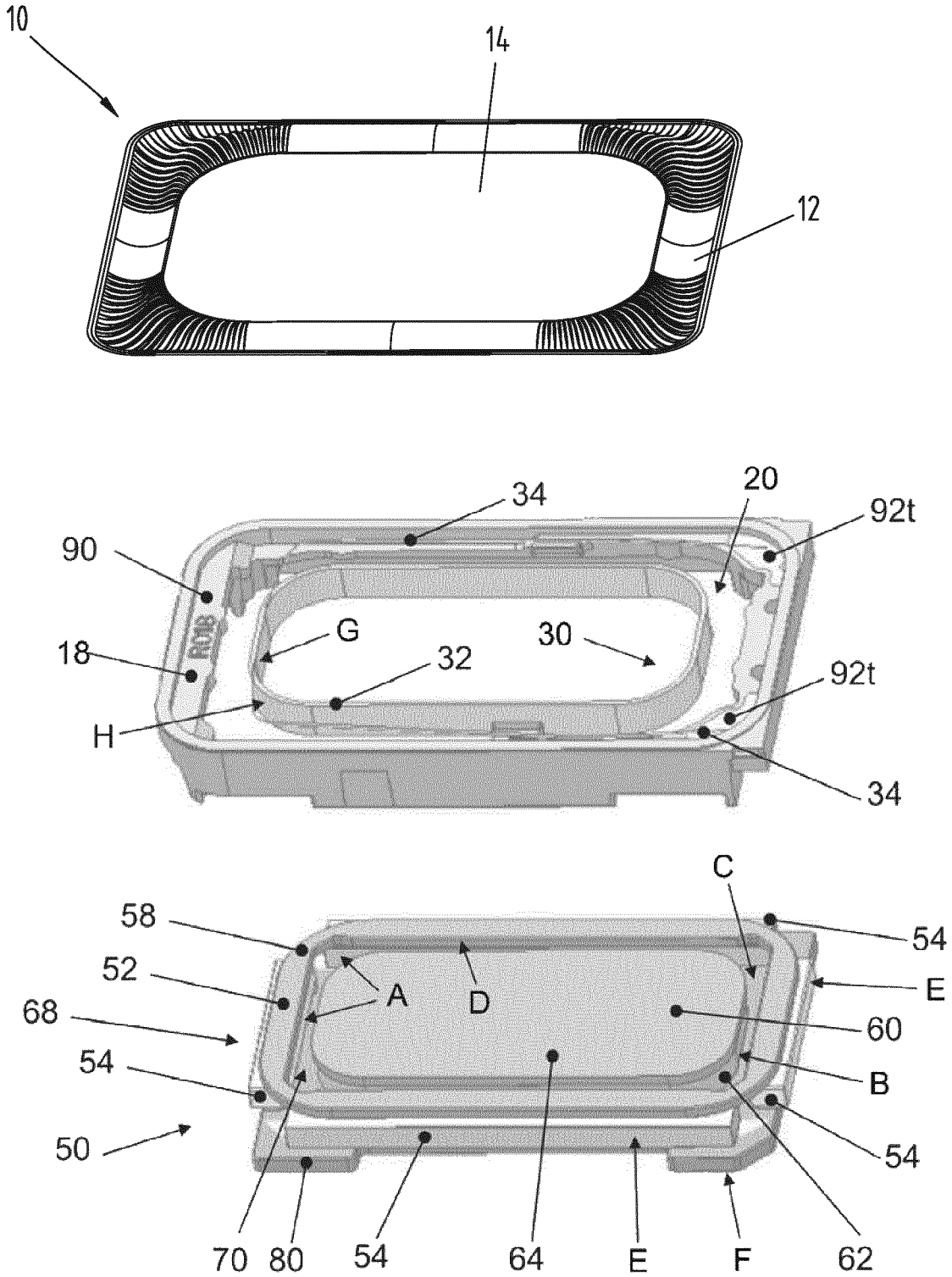
FIG. 1 shows an exploded top perspective view of the relevant parts of a first embodiment of a rectangular micro speaker.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

All directional references (e.g., "plus", "minus", "upper", "lower", "upward", "downward", "left", "right", "leftward", "rightward", "front", "rear", "top", "bottom", "over", "under", "above", "below", "vertical", "horizontal", "clockwise", and "counterclockwise") are only used for identification purposes to aid the reader's understanding of the present disclosure, and do not create limitations, particularly as to the position, orientation, or use of the any aspect of the disclosure. It is to be understood that the terms so used are interchangeable under appropriate circumstances such that the embodiments of the invention described herein are, for example, capable of operation in other orientations than those illustrated or otherwise described herein.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., "attached", "coupled", "connected", and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

All numbers expressing measurements and so forth used in the specification and claims are to be understood as being modified in all instances by the term "about."

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

FIG. 1 shows a perspective view of a first embodiment of a rectangular micro speaker 10.

Speaker 10 comprises a membrane 12. Membrane 12 may also include a membrane plate 14 to stiffen membrane 12. Speaker 10 furthermore comprises a coil 32 with leads 34. An electrical signal to drive coil 32 is fed into coil 32 through leads 34. Coil 32 of assembled speaker 10 is fixed to membrane 12 with an adhesive, such as, for example, glue, tape, or other adhesives known in the art.

Micro speaker 10 includes a magnet system 50 which may comprise a perimeter magnet assembly 52 and a center magnet assembly 60. Perimeter magnet assembly 52 may include four magnets 54 arranged on the rectangular sides of the rectangular speaker 10 and ring plate 58 fixed to magnets 54. Center magnet assembly 60 includes magnet 62 arranged in the center of speaker 10 and top plate 64 fixed to magnet 62. Perimeter magnet assembly 52, center magnet assembly 60, and pot plate 80 affixed to perimeter and center magnet assemblies 52, 60 opposite ring and top plates 58, 64 form magnetic field guide 68. Magnetic field guide 68 guides and focuses the magnetic field of magnets 54 and 62 in an air gap 70 between perimeter magnet assembly 52 and center magnet assembly 60, into which coil 32 is arranged in the assembled speaker 10.

Figure 2A:
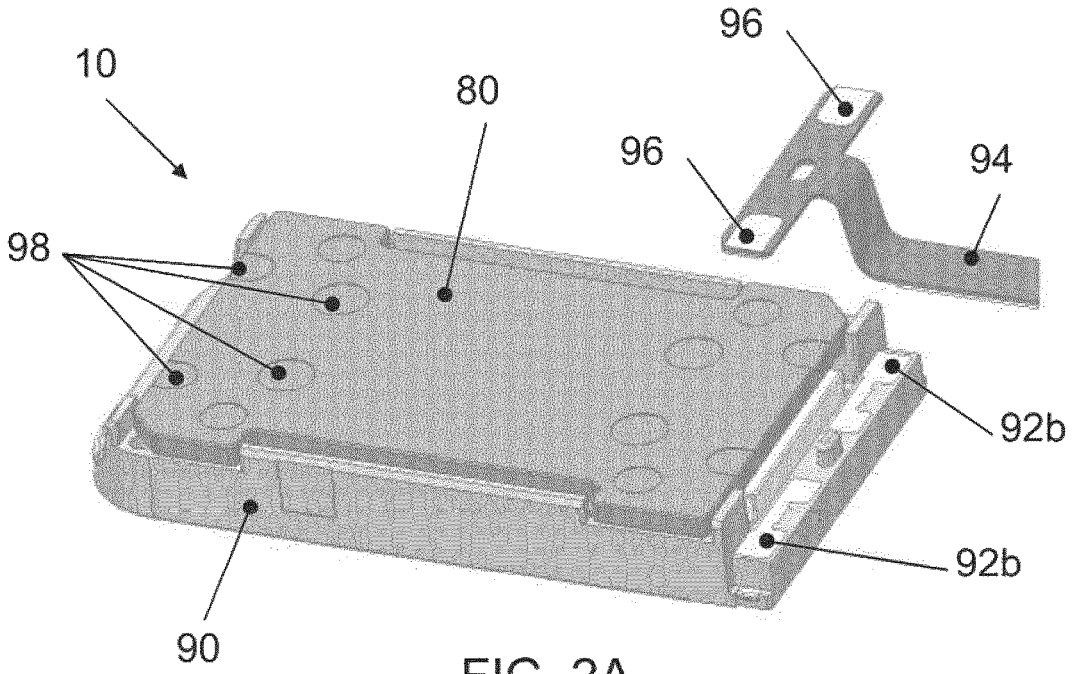
FIG. 2A shows a bottom perspective view of the relevant parts of the first embodiment of the rectangular micro speaker.
Figure 2B:
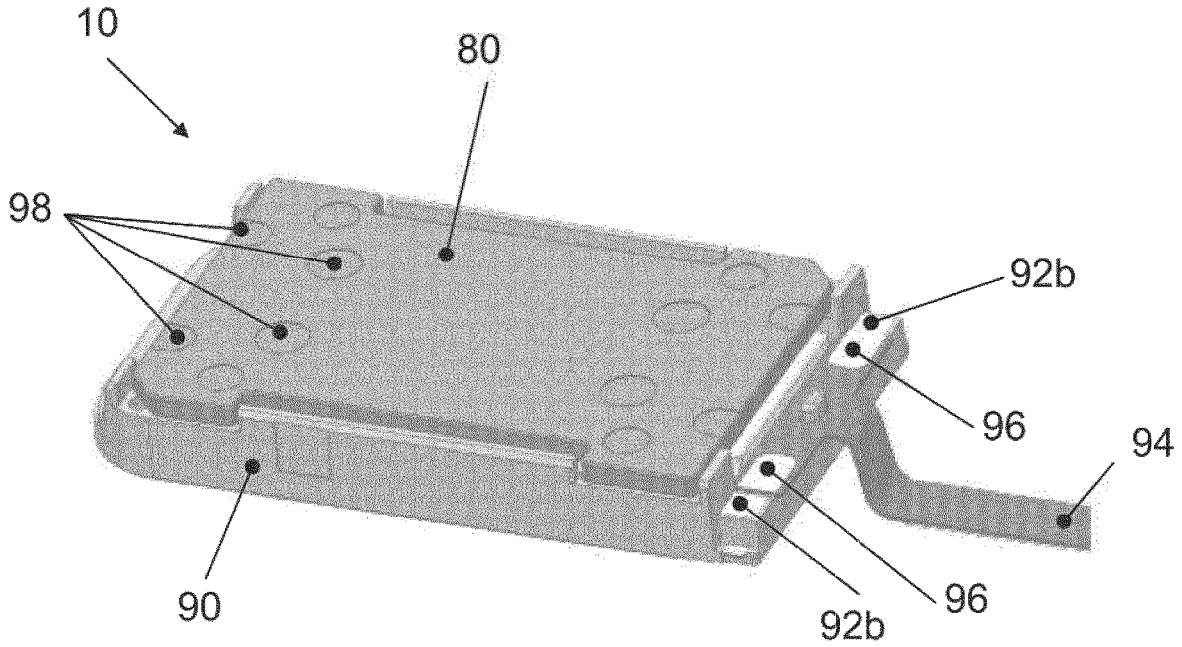
FIG. 2B shows a bottom perspective view of the relevant parts of the first embodiment of the rectangular micro speaker.

Micro speaker 10 further includes frame 90 to assemble and align membrane 12 with magnet system 50. Coil 32 fits into air gap 70 and is able to translate up and down within air gap 70 according to the electrical signal fed into coil 32 through leads 34. Frame 90 typically is made from a molded plastic which enables frame 90 to have a complex surface with openings which permit airflow and fixation of other parts of speaker 10. The ends of leads 34 of coil 32 are soldered to contact pads 92*t*, that are fixed in to top side of frame 90 during an assembly process. As shown in FIG. 2A, the bottom side of frame 90 includes contact pads 92*b* which are electrically connected with contact pads 92*t* on the top side of frame 90. As shown in FIG. 2B, a further electrical connection is made with flexible printed circuit 94 which includes contact pads 96. Contact pads 96 of flexible printed circuit 94 are soldered to contact pads 92*b* during an assembly process. The electrical signal to drive coil 32 is fed through flexible printed circuit 94, contact pads 96, contact pads 92*b*, contact pads 92*t*, and into leads 34. Furthermore as shown in FIGS. 2A and 2B, pot plate 80 includes bottom vents 98 which permit airflow between a back volume (not shown) and the back volume side of the membrane 12. Bottom vents 98 permit an undistorted vibration of membrane 12 according to the electrical signal fed into coil 32.

Figure 3:
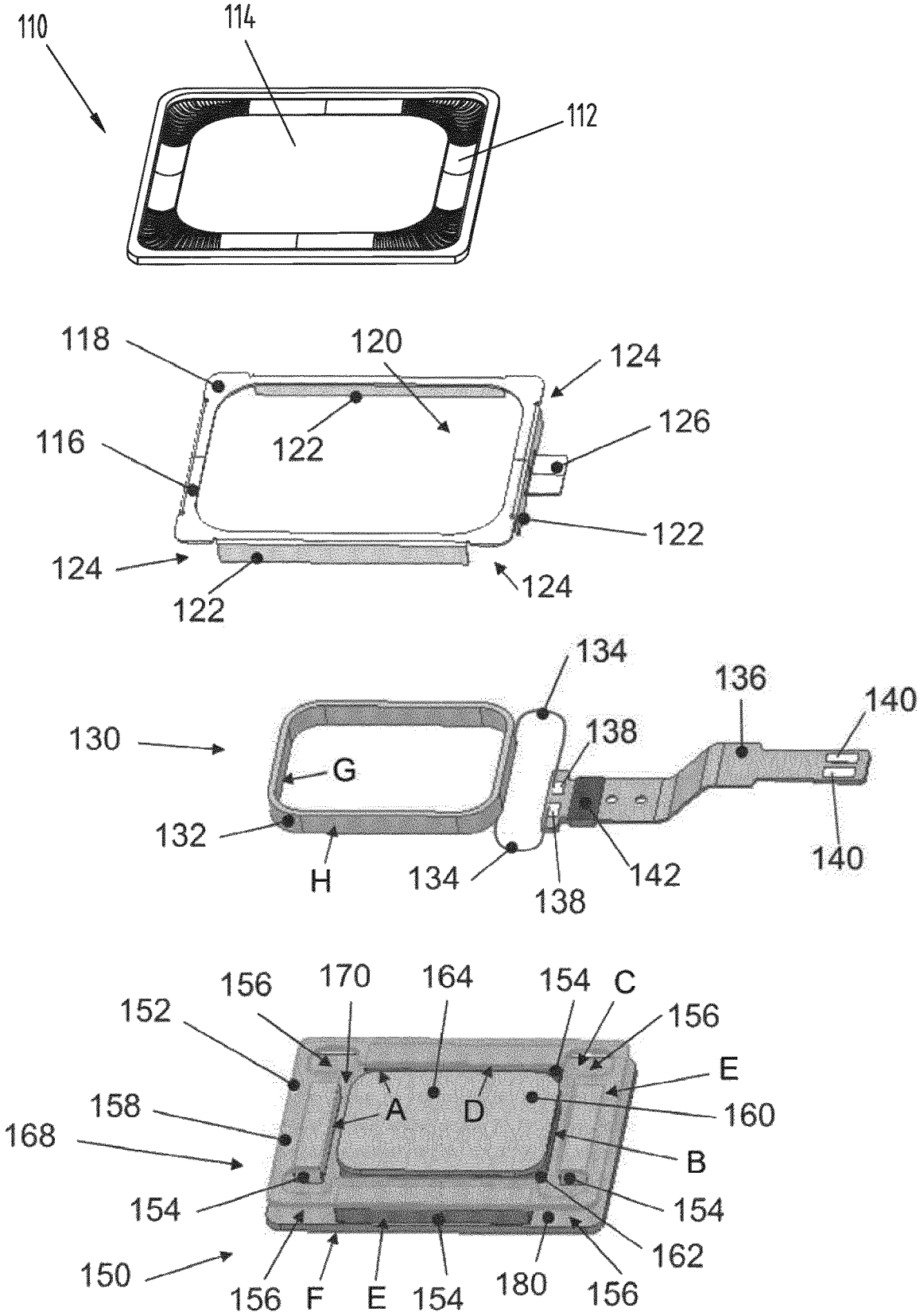
FIG. 3 shows an exploded top perspective view of a rectangular micro speaker according to a second embodiment.
Figure 4:
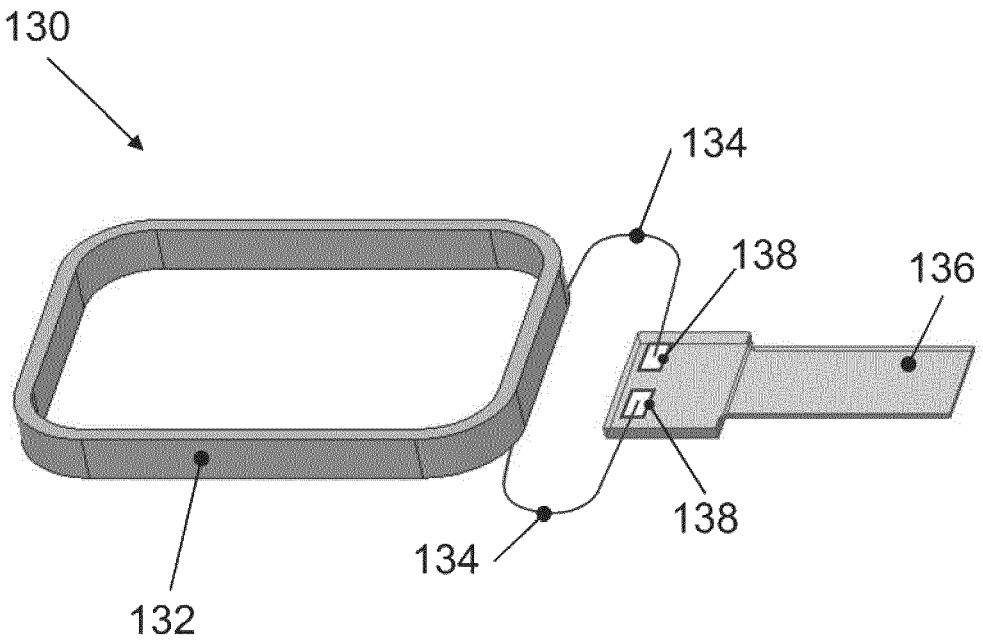
FIG. 4 shows a top perspective view of a coil assembly of a rectangular micro speaker according to the second embodiment.
Figure 5:
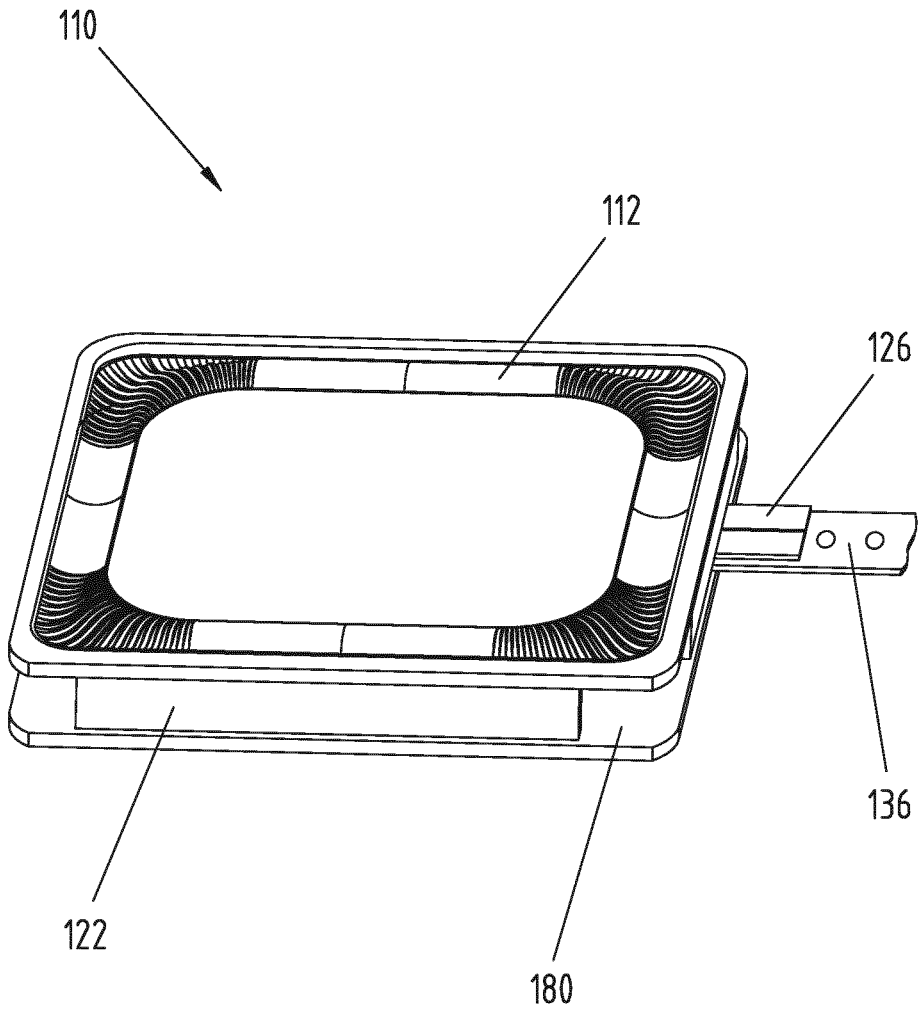
FIG. 5 shows a top perspective view of a rectangular micro speaker according to the second embodiment.
Figure 7:
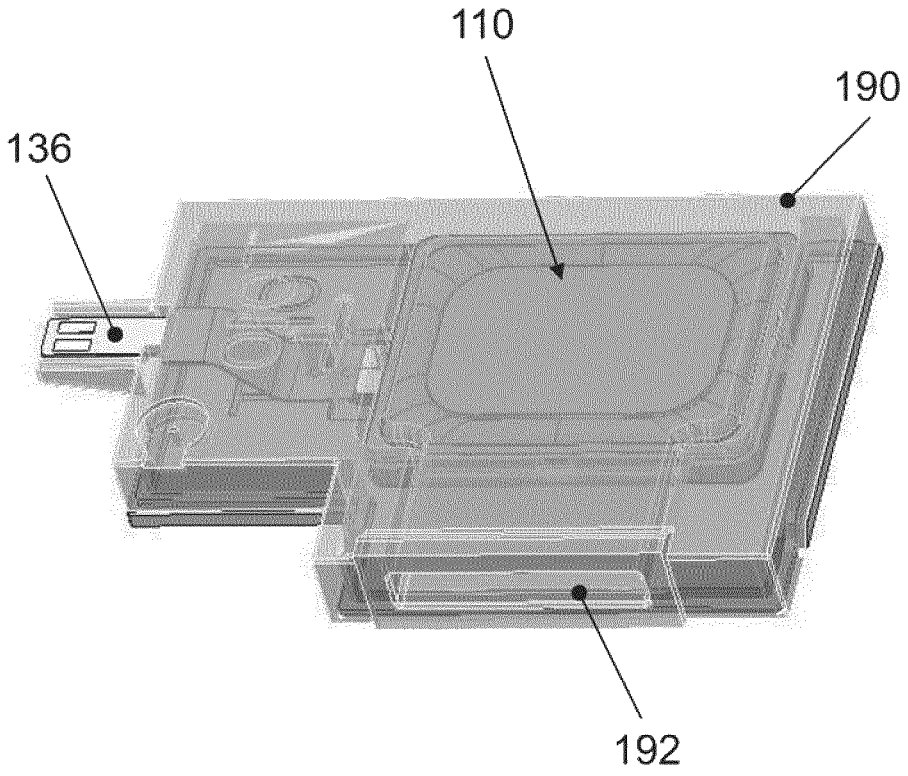
FIG. 7 is a top perspective view of a rectangular micro speaker within an enclosure according to the second embodiment.

The relevant parts of a second embodiment of the invention are shown in FIGS. 3, 4, 5, and 7. FIG. 3 shows an exploded perspective view of the relevant parts of a rectangular speaker 110. FIG. 4 shows a perspective view of an assembly of a coil 132 and flexible printed circuit 136. FIG. 5 shows a top perspective view of the relevant parts of the assembled speaker 110. FIG. 7 is a top perspective view of the assembled speaker 110 within an enclosure 190.

Speaker 110 comprises a membrane 112, a collar 116, a coil assembly 130, a magnet system 150, and a pot plate 180. Membrane 112 may be built out of one or more layers of material, such as, for example, Ethere Ketone (PEEK), Acrylate and/or Thermoplastic Elastomeric (TEP), Polyetherimide (PEI), and/or other materials known in the art. Membrane 112 may also include a membrane plate 114 to stiffen membrane 112.

Speaker 110 includes a magnet system 150 comprising a perimeter magnet assembly 152 and a center magnet assembly 160. Perimeter magnet assembly 152 includes four magnets 154 arranged on the rectangular sides of the rectangular speaker 110 and ring plate 158 fixed to magnets 154. Center magnet assembly 160 includes magnet 162 arranged in the center of speaker 110 and top plate 164 fixed to magnet 162. Perimeter magnet assembly 152, center magnet assembly 160, and pot plate 180 affixed to perimeter and center magnet assemblies 152, 160 opposite ring and top plates 158, 164 form magnetic field guide 168. Magnetic field guide 168 guides and focuses the magnetic field of magnets 154 and 162 in an air gap 170 between perimeter magnet assembly 152 and center magnet assembly 160, into which coil 132 is arranged in the assembled speaker 110.

Speaker 110 includes coil assembly 130 having coil 132, leads 134, and flexible printed circuit 136. An electrical signal to drive coil 132 is fed into coil 132 through flexible printed circuit 136 and leads 134. Coil 132 of assembled speaker 110 is fixed to membrane 112 with an adhesive, such as, for example, glue, tape, or other adhesives known in the art. Optionally, leads 134 of coil 132 may directly be connected to flexible printed circuit 136 as shown in the Figures. In this case, flexible printed circuit 136 includes a pair of contact pads 138 on a first terminal end of flexible printed circuit 136, which are in electrical communication with contact pads 140 on a second terminal end of the printed circuit 136 opposite the first. The electrical communication between contact pads 140 and 138 may be accomplished using traces and/or vias as is known in the art. Leads 134 are electrically connected by a solder connection to contact pads 138 to permit an electrical signal to flow from a source (not shown) into contact pads 140, through traces and/or vias in flexible printed circuit 136, through contact pads 138, through leads 134 and into coil 132. It will be understood by those in the art, that in various embodiments, the electrical connection between leads 134 and flexible printed circuit 136 may be accomplished in a variety of ways known in the art, for example, by inserting leads 134 into an electrical connector affixed to flexible printed circuit 136. Electrical connection of the coil 132 may also be accomplished as shown in FIGS. 1 to 2B.

As can be seen in FIG. 3, frame 90 of micro speaker 10 is replaced with collar 116 in the second embodiment. Collar 116 has a first portion 118 that is substantially horizontal and substantially parallel with pot plate 180. A substantially rectangular opening 120 is provided in first portion 118 through which coil 132 may translate during operation of speaker 110. First portion 118 serves as a rim to which the perimeter of membrane 112 is affixed typically, for example, by glue or adhesive. Extending downward and substantially perpendicular from the sides of first portion 118 of collar 116 is a second portion, shown as side tabs 122. Preferably, collar 116 includes four (4) side tabs; however, it will be understood that, in various embodiments, for example, collar 116 may include from about two (2) tabs to about four (4) tabs (e.g., two (2) tabs, three (3) tabs, four (4) tabs). In other embodiments, collar 116 may include less than two (2) tabs. In yet other embodiments, collar 116 may include more than four (4) tabs.

With continued reference to FIG. 3, collar 116 further includes optional openings 124 proximate the corners of collar 116 between tabs 122. Preferably, collar 116 includes four (4) openings; however, it will be understood that, in various embodiments, for example, collar 116 may include from about two (2) openings to about four (4) openings (e.g., two (2) openings, three (3) openings, four (4) openings). In other embodiments, collar 116 may include less than two (2) openings. In yet other embodiments, collar 116 may include more than four (4) openings.

Openings 124 serve as side vents, which permit airflow between a back volume (not shown) and the back volume side of membrane 112. As illustrated in FIGS. 3 and 5, openings 124 are substantially aligned with the gaps 156 between magnets 154 of magnet system 150 and thus speaker 110 includes a substantially clear air pathway between the back volume and the back volume side of membrane 112. Therefore, openings 124 permit an undistorted vibration of membrane 112 in response to the electrical signal fed into coil 132. With the inclusion of openings 124 on collar 116, back vents are not required in pot plate 180. By not requiring back vents on pot plate 180, the geometry and/or features of pot plate 180 can be simplified as compared to pot plate 80, thus reducing component cost. It will be understood however, that in various embodiments, in addition to or alternative to openings on collar 116, back vents may be provided on pot plate 180.

Advantageously, collar 116 is made of metal. In this way, collar 116 provides very good heat storage and heat transmission capability. By omission of frame 90, which is usually made of plastic, heat dissipation in general is improved as heat does not have to pass frame 90, which in common neither has a very good heat storage capability nor a very good heat transmission capability.

Collar 116 may be mounted to pot plate 180, to ring plate 158 or to both. For example, collar 116 can be glued or welded to pot plate 180 and/or to ring plate 158, especially by means of laser welding or ultrasonic welding.

Preferably, collar 116 further includes a stabilizing tab 126 extending substantially horizontally from right tab 122. As shown in FIG. 5, stabilizing tab 126 interfaces with flexible printed circuit 136, serves to stabilize flexible printed circuit 136, provides protection between the electrical connection between leads 134 and contact pads 138, and maintains the positions of collar 116 and coil assembly 130 in speaker 110. Stabilizing tab 126 is affixed to flexible printed circuit 136 using an adhesive 142 (see FIG. 3), such as, for example, glue, tape, or other adhesives known in the art.

As shown in FIGS. 3 and 4, leads 134 of coil 132 extend from the side of coil 132 proximate flexible printed circuit 136 and each lead 134 forms a short loop. This allows leads 134 to be shorter in length than leads 34 of micro speaker 10. However, in other embodiments, for example, leads 134 of coil 132 may extend from the side of coil 132 distal flexible printed circuit 136 and loop inward to be electrically connected to contact pads 138 of flexible printed circuit 136. As shown, leads 134 extend from the bottom of coil 132 and may be substantially horizontal and substantially in-plane with flexible printed circuit 136 when coil is in the rest position. In various embodiments, speaker 110 may also include one or more of the support members for supporting coil 132 and/or leads.

The assembled speaker 110 is shown in FIG. 5.

Figure 6A:
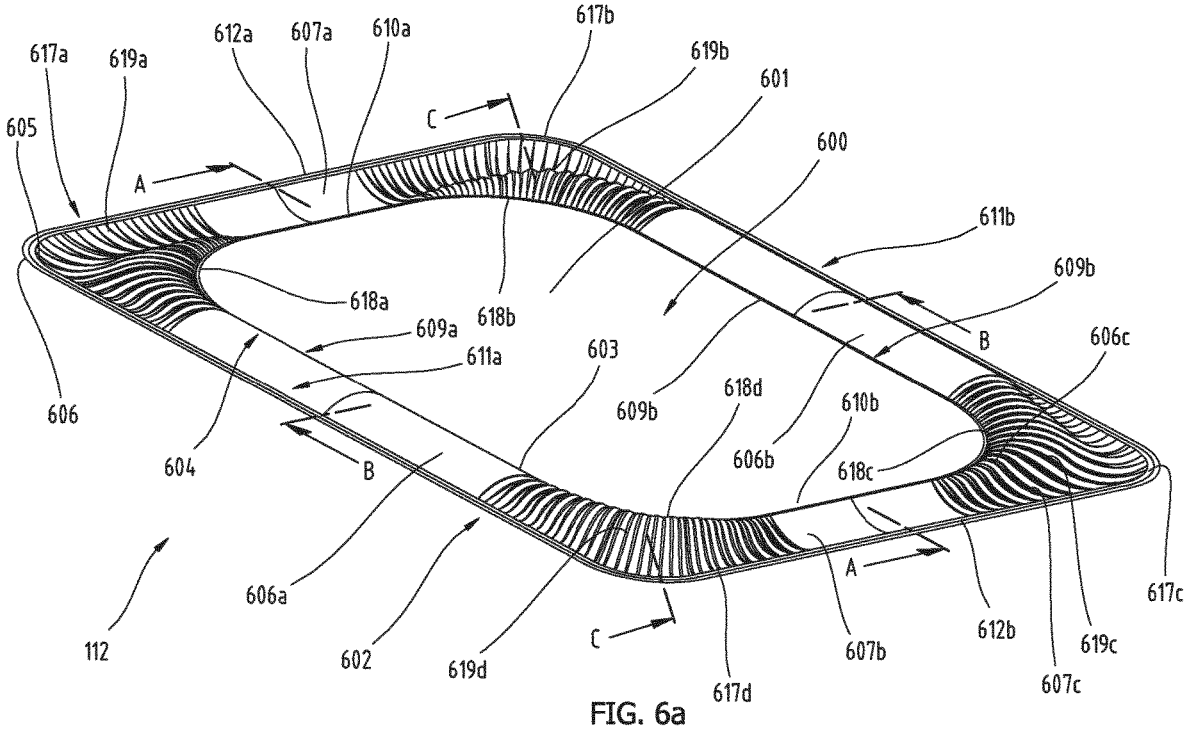
FIG. 6*a* shows a first embodiment of a membrane according the invention.

FIG. 6*a* shows the membrane 112 in a perspective view. The membrane 112 comprises a central portion 600 with a sound emitting surface area 601 and a back surface area 602 located opposite the sound emitting surface area 601. The central portion 600 is of a generally rectangular shape with rounded corners. Sound emitting surface area 601 and the back surface 602 area of the central portion 600 constitute at least 60 percent of the overall surface area of the membrane 112.

Preferably an area of a top surface of the membrane 112 lies within a range of 0.4 to 5 $cm^2$.

Membrane 112 comprises a first edge 603 directly adjacent to the central portion 600 and surrounding the central portion 600 like a ring. The first edge 603 constitutes a boundary line between the central portion 600 and an adjacent area 604 comprising a different surface curvature than the central portion 600. Membrane 112 further comprises a second edge 605 surrounding the first edge 603. The second edge 605 directly merges into a clamping collar 606 for mounting the membrane 112 to the loudspeaker.

An intermediate portion 604 is located between the first edge 603 and the second edge 605. The intermediate portion 604 comprises convex shaped sections 606*a*, 606*b* and concave shaped section 607*a*, 607*b*, with respect to the sound emitting surface area 601 of the central portion 600.

The first edge 603 comprises a first side 609*a* and a second side 609*b* running parallel to each other. Edge 603 further comprises a third side 610*a* and a fourth side 610*b* running parallel to each other. A ratio between the first side 609*a* and the third side 610*a* preferably lies within a range between 1:1 and 3:1. A ratio of 1:1 correlates to a square or rhombic shape of the edge, whereas a ratio of 3:1 correlates to a rectangular or parallelogram shape of the first edge 603.

The second edge 605 comprises a first side 611*a* and a second side 611*b* running parallel to each other. Second edge 605 further comprises a third side 612*a* and a fourth side 612*b* running parallel to each other. A ratio between the first side 611*a* and the third side 612*a* preferably lies within a range between 1:1 and 3:1. A ratio of 1:1 correlates to a square or rhombic shape of the edge, whereas a ratio of 3:1 correlates to a rectangular or parallelogram shape of the second edge 605.

The first side 609*a* and the second side 609*b* of the first edge 603 run parallel to the first side 611*a* and the second side 611*b* of the second edge 605. The third side 610*a* and the fourth side 610*b* of the first edge 603 run parallel to the third side 612*a* and fourth side 612*b* of the second edge 605.

According to FIG. 6*a* the first edge 603 and the second edge 604 each define a polygon in the form of a rectangle. But it should be mentioned that other forms of tetragons instead of a rectangle are possible as well. The first edge 603 and the second edge 604 each could define a trapezoid, a pentagon, hexagon etc.

The convex shaped section 606*a* is arranged between the first side 609*a* of the first edge 603 and the first side 611*a* of the second edge 605. The concave shaped section 607*a* is arranged between the third side 610*a* of the first edge 605 and the third side 612*a* of the second edge 605. The convex shaped section 606*b* is arranged between the second side 609*b* of the first edge 603 and the second side 611*b* of the second edge 605. The concave shaped section 607*b* is arranged between the fourth side 610*b* of the first edge 605 and the fourth side 612*b* of the second edge 605.

The convex shaped section 606*a* connects the first side 609*a* of the first edge 603 and the first side 611*a* of the second edge 605. The concave section 607*a* connects the third side 610*a* of the first edge 603 to the third side 612*a* of the second edge 605. The convex shaped section 606*b* connects the second side 609*b* of the first edge 603 and the second side 611*b* of the second edge 605. The concave section 607*b* connects the fourth side 610*b* of the first edge 603 to the fourth side 612*b* of the second edge 605.

The first edge 603 defines a tetragon with rounded corners 618*a*-618*d*. Furthermore, the second edge 605 also defines a tetragon with rounded corners 617*a*-617*d*. The intermediate area 604 of the membrane 112 comprises a Leporello fold shape within each area 619*a*-619*d* located between rounded corners 618*a*-618*d* of the first edge 603 and the rounded corners 617*a*-617*d* of the second edge 605, respectively. Each of the areas 619*a*-619*d* connect the respective rounded corners 618*a*-618*d* of the first edge 603 to the respective rounded corners 617*a*-617*d* of the second edge 605.

The shape of the intermediate portion 604 changes from a concave shape 607*a*, 607*b* to a convex shape 606*a*, 606*b* within areas 619*a*-619*d*. But the shape of the intermediate portion 604 may also change from a convex-concave shape to a convex or concave shape. In particular, a shape of the intermediate portion 604 may change from a convex-concave shape to another convex-concave shape within one or more of areas 619*a*-619*d*.

As shown in FIGS. 6*a* and 6*a* a concave shaped section 607*c* of the intermediate portion 604 may merge into a convex shaped section 606*c* of the intermediate portion or vice versa viewed in direction of a shortest distance between the first edge 603 and the second edge 605.

Figure 6B:
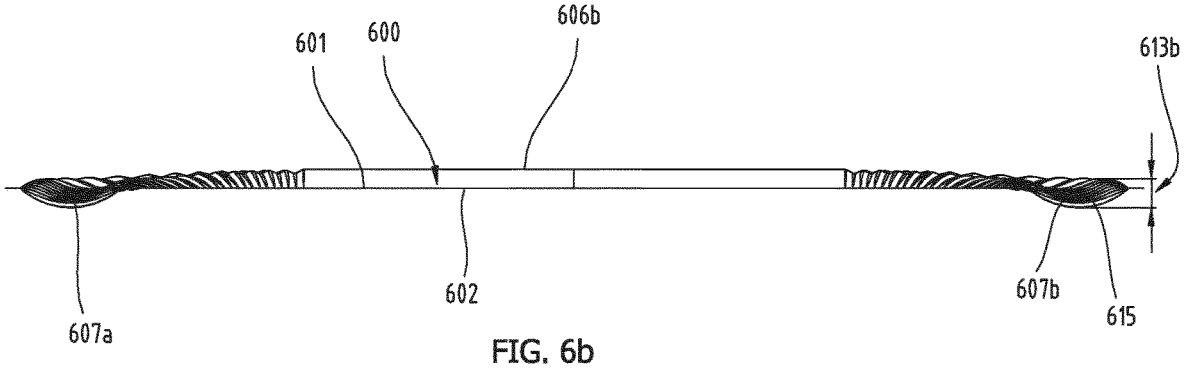
FIG. 6*b* shows a cross section along line A-A in FIG. 6*a;*

A cross-section of the concave shaped sections 607*a*, 607*b* along a line A-A normal to the first edge 603 is of a U-shaped form as can be seen in FIG. 6*b*. According to FIG. 6*c* a cross-section of the convex shaped sections 606*a*, 606*b* along a line B-B normal to the first edge 603 is also of a U-shaped form.

Figure 6C:
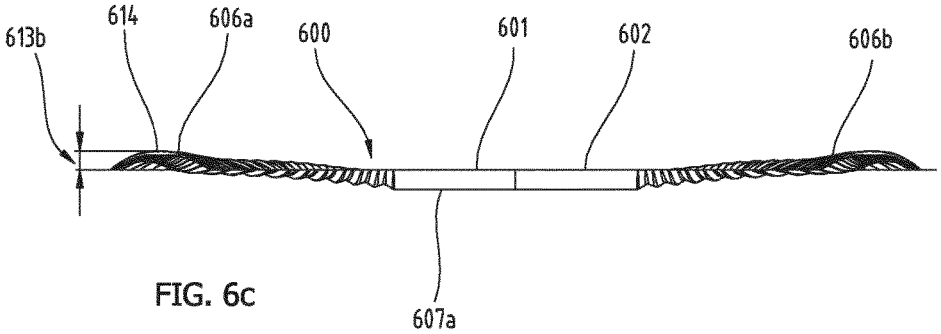
FIG. 6*c* shows a cross section along line B-B in FIG. 6*a;*
Figure 6D:
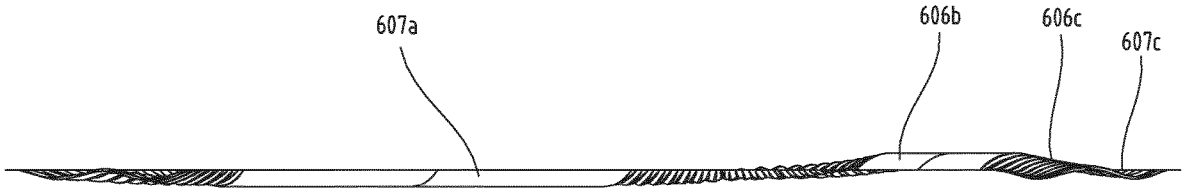
FIG. 6*d* shows a cross section along line C-C in FIG. 6*a;*

As can be seen in FIGS. 6*b* and 6*c* the concave shaped section 607*a* is disposed above the central portion 600 in a horizontal position of the central portion 600. According to the convex shaped section 606*a* is disposed under the central portion 600 in a horizontal position of the central portion 600.

In the horizontal position of the central portion 600 a distance 613*a* between a level of a vertex 614 of the convex shaped sections 606*a*, 606*b* and a level of the sound emitting surface 601 may be of the same absolute value like a distance 613*b* between a vertex 615 of the concave shaped sections 607*a*, 607*b* and the level of the sound emitting surface 601 of the central portion 600.

As can be seen in FIGS. 6*b* and 6*c* central portion 600 is disposed between the concave shaped section 607*a* and the convex shaped section 606*a* viewed in a vertical direction and a horizontal direction.

A thickness of the material of the membrane 112 can be constant all over the intermediate portion 604. The membrane 112 is typically built out of one or more layers of material, such as, for example, Ethere Ketone (PEEK), Acrylate and/or Thermoplastic Elastomeric (TEP), Polyetherimide (PEI), and/or other materials known in the art.

Figure 6E:
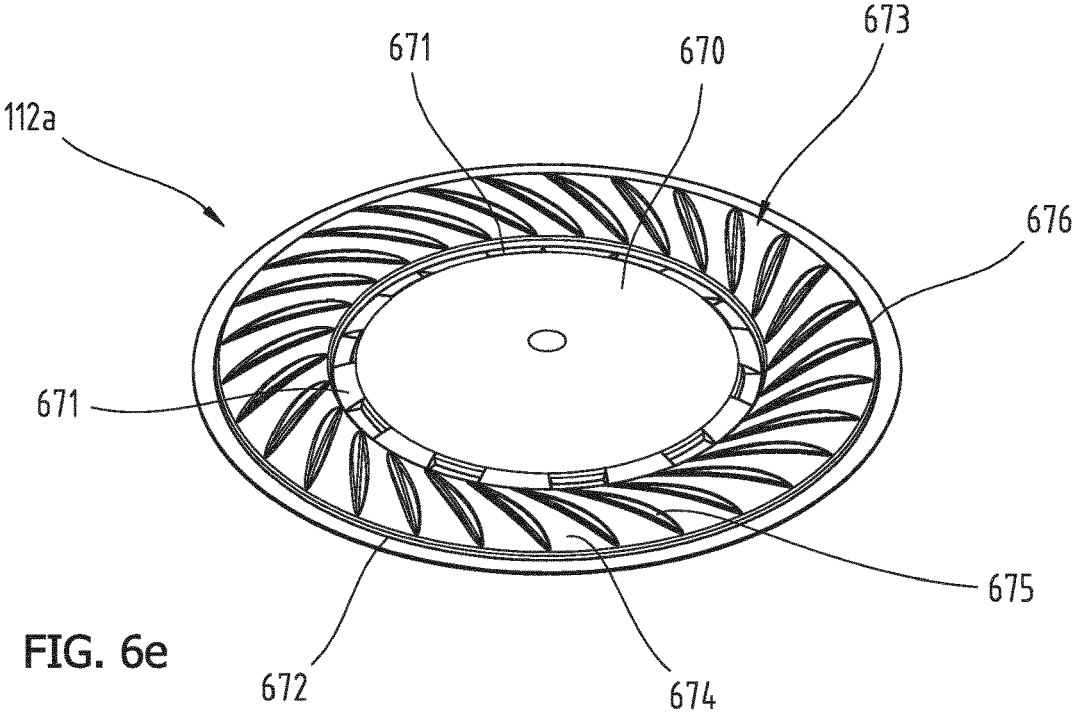
FIG. 6*e* shows a perspective view of a second embodiment of a membrane.
Figure 6F:
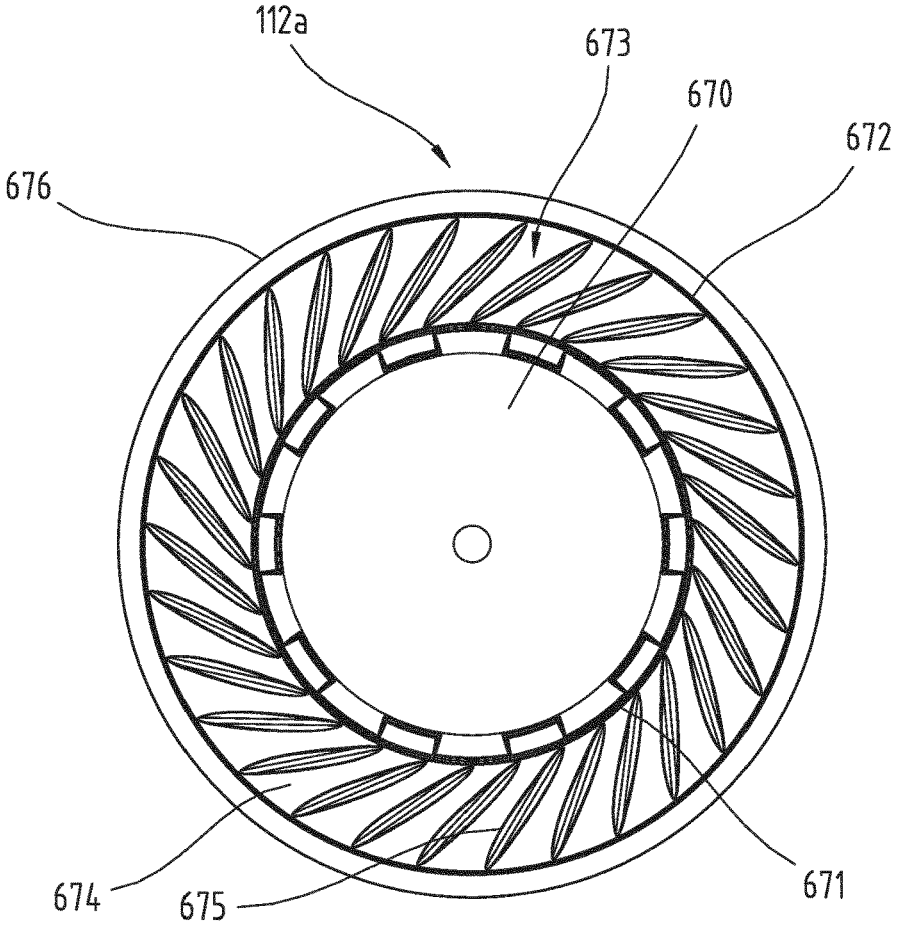
FIG. 6*f* shows a top view of the membrane from FIG. 6*e;*

As shown in FIGS. 6*e* and 6*f* membrane 112*a* may have a shape of conic section in the form of circle. Membrane 112*a* comprises a central portion 670, a first edge 671 and a second edge 672. The second edge merges into a clamping collar 676. An intermediate portion 673 located between the first edge 671 and the second edge 672 comprises a convex shaped portion 674 and concave shaped portions 675. The concave shaped portions 675 are realized by means of indentations.

Assembled speaker 110, may be installed in an enclosure 190 as shown in FIG. 7. Enclosure 190 is illustrated with a sound path terminating in a side firing port 192; however, it will be understood that in various embodiments, the enclosure of speaker 110 may include a sound path terminating in a top or bottom firing port. Enclosure 190 further includes a passageway through which flexible printed circuit 136 exits so that it may be connected to circuitry source (not shown) for driving speaker 110.

Figure 8A:
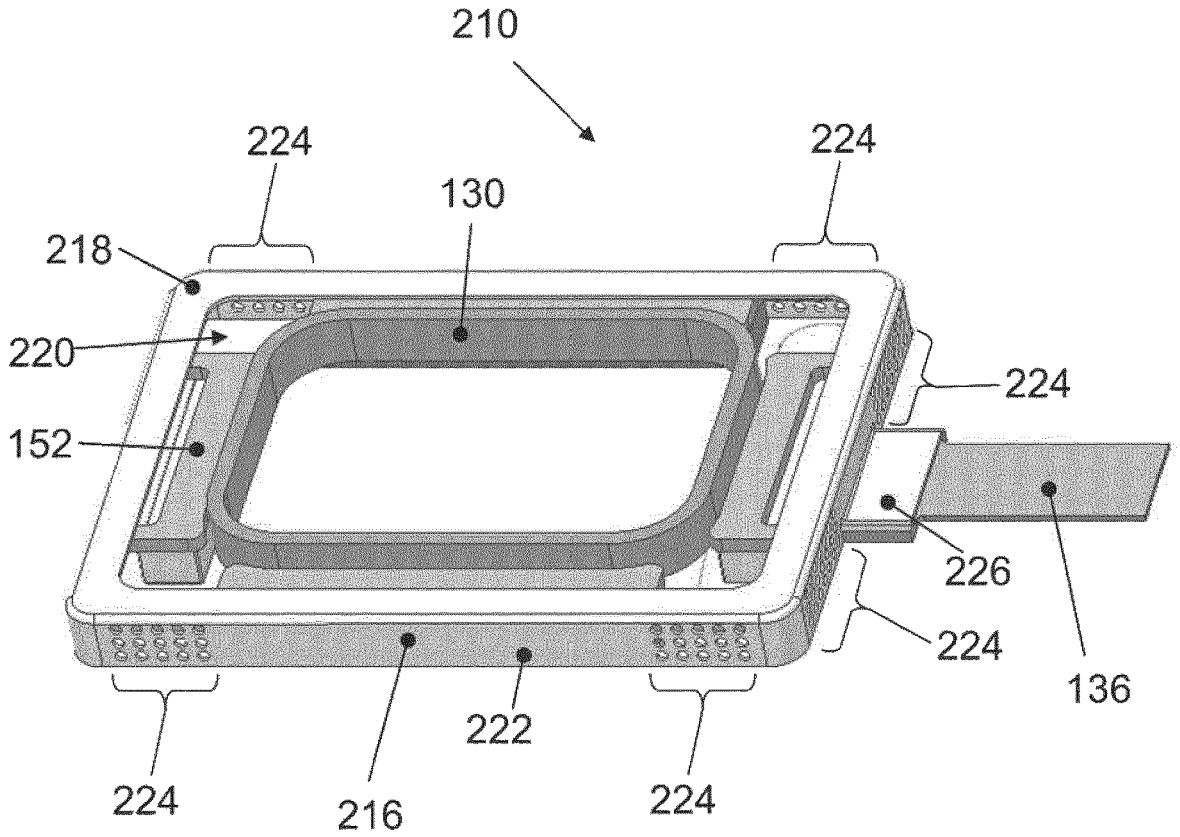
FIG. 8A is a top perspective view of a collar of a rectangular micro speaker according to a third embodiment.
Figure 8B:
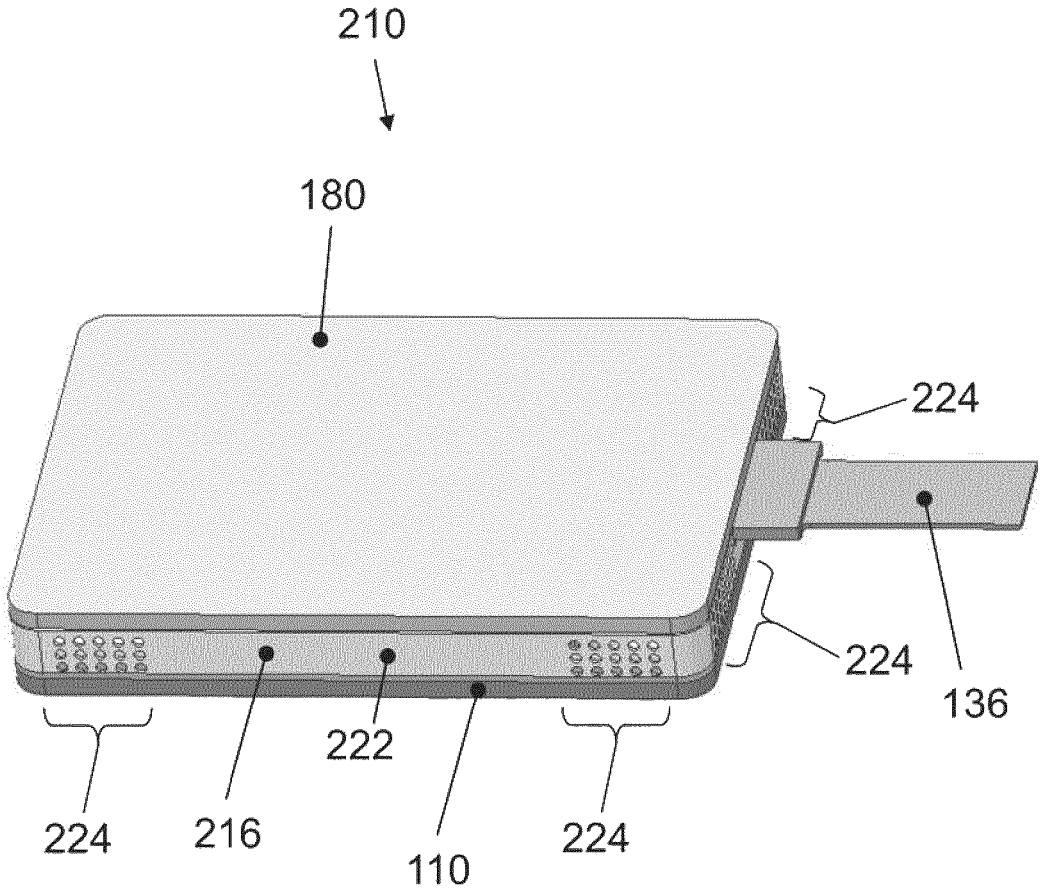
FIG. 8B is a bottom perspective view of a rectangular micro speaker according to a third embodiment.

Another embodiment of speaker 210 of the invention is illustrated in FIGS. 8A, 8B and are described below. Some features of one or more of speakers 110 and 210 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

With reference to FIG. 8A, a portion of speaker 210 is shown. Speaker 210 comprises a membrane 112, a collar 216, a coil assembly 130, a magnet system 150, and a pot plate 180. Speaker 210 is substantially the same as speaker 110 except for the design of collar 216. collar 216 has a first portion 218 that is substantially horizontal and substantially parallel with pot plate 180 (see FIG. 8B). A substantially rectangular opening 220 is provided in first portion 218 through which coil 132 may translate during operation of speaker 210. First portion 218 serves as a rim to which the perimeter of membrane 112 is affixed typically, for example, by glue or adhesive. Extending downward and substantially perpendicular from the sides of first portion 218 of collar 216 is a second portion, shown as sidewall 222. Sidewall 222 extends around the perimeter of collar 216.

With continued reference to FIG. 8A, sidewall 222 includes a population of openings 224 extending through sidewall 222 proximate the corners of collar 216. Openings 224 are shown as substantially circular holes arranged in rows and columns. In various embodiments, for example, openings 224 may be laser cut into sidewall 222. Openings 224 serve as side vents which permit airflow between a back volume (not shown) and the back volume side of membrane 112. As illustrated in FIG. 8A, openings 224 are substantially aligned with the gaps between magnets 154 of magnet system 150 and thus speaker 210 includes a substantially clear air pathway between the back volume and the back volume side of membrane 112. Therefore, openings 224 permit an undistorted vibration of membrane 112 in response to the electrical signal fed into coil 132. With the inclusion of openings 224 on collar 216, back vents are not required in pot plate 180 as shown in FIG. 8B. By not requiring back vents on pot plate 180, the geometry and/or features of pot plate 180 can be simplified as compared to pot plate 80, thus reducing component cost. It will be understood however, that in various embodiments, in addition to or alternative to openings on collar 216, back vents may be provided on pot plate 180.

By use of the design shown in FIGS. 8A and 8B furthermore the volume and the surface of the collar 216 is increased in comparison to the collar 116 of the speaker 110 shown in FIGS. 3 to 7. Accordingly, heat absorbing capability, heat radiation capability, heat transmission capability and heat storage capability is improved in comparison to the collar 116 of the speaker 110 shown in FIGS. 3 to 7.

It will be understood that the number and/or the size of openings 224 may be altered to provide the appropriate side venting to a back volume (not shown) to achieve the desired acoustic performance for speaker 210. Furthermore, as described in U.S. Provisional Application Ser. No. 62/237,961 filed on Oct. 6, 2015, entitled "Electroacoustic Transducer," the entire disclosure of which is incorporated by reference, openings 224 may have a maximum dimension smaller than an adsorber material filled into an enclosure. The adsorber material may be, for example, the zeolite material described in U.S. Published Patent Application 2013/0170687, published on Jul. 4, 2013, entitled "Loudspeaker System with Improved Sound."

Collar 216 further includes a stabilizing tab 226 extending substantially horizontally from sidewall 222. As shown in FIG. 8A, stabilizing tab 226 interfaces with flexible printed circuit 136, serves to stabilize flexible printed circuit 136, provides protection between the electrical connection between leads 134 and contact pads 138, and maintains the positions of collar 216 and coil assembly 130 in speaker 210. Stabilizing tab 226 is affixed to flexible printed circuit 136 using an adhesive 142 (see FIG. 3), such as, for example, glue, tape, or other adhesives known in the art.

Figure 9A:
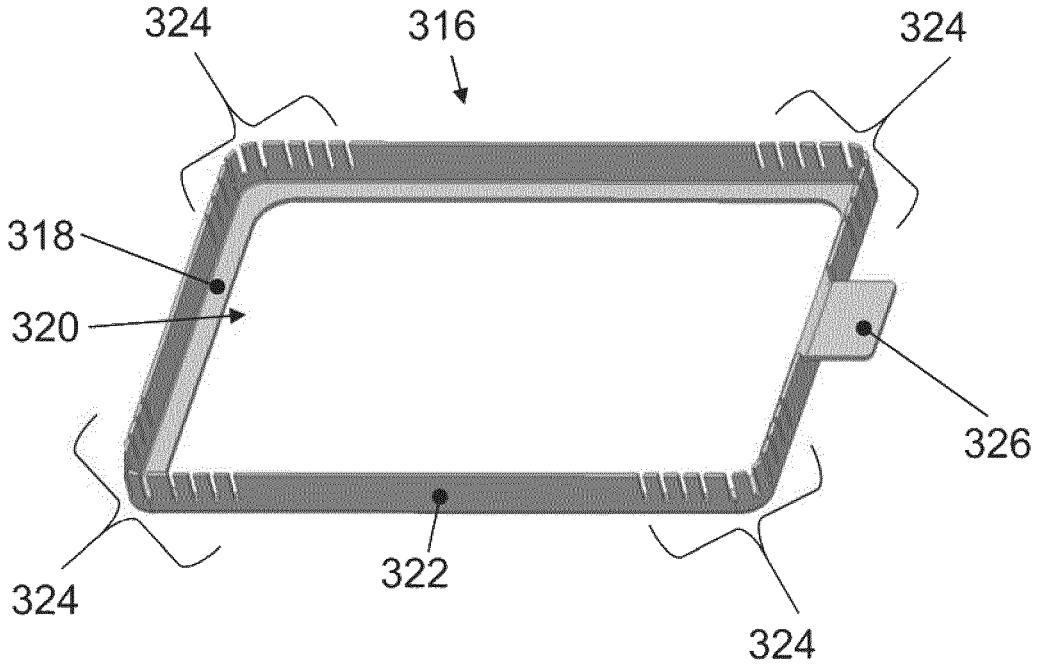
FIG. 9A is a bottom perspective view of a collar of a rectangular micro speaker according to the fourth embodiment.
Figure 9B:
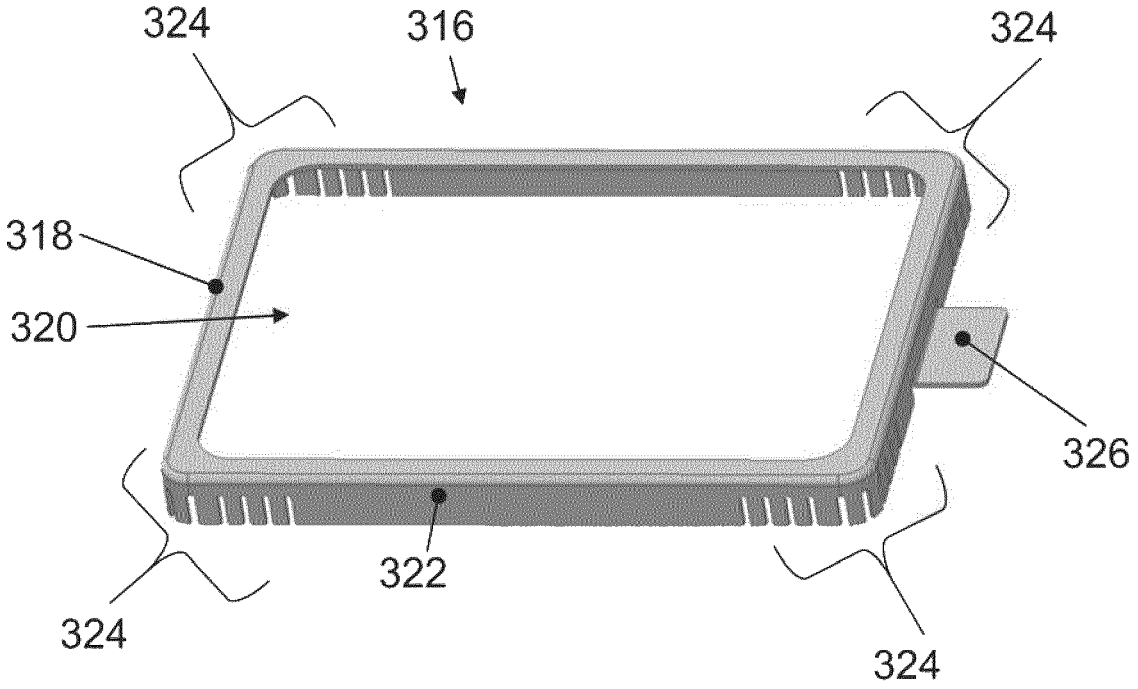
FIG. 9B is a top perspective view of a collar of a rectangular micro speaker according to the fourth embodiment.

Another embodiment of collar 316 of the invention is illustrated in FIGS. 9A, 9B and are described below. Some features of one or more of collars 216 and 316 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Collar 316 has a first portion 318 that is substantially horizontal and substantially parallel with a pot plate 180. A substantially rectangular opening 320 is provided in first portion 318 through which a coil 132 may translate during operation of a speaker 110. First portion 318 serves as a rim to which the outer perimeter of a membrane 112 is affixed typically, for example, by glue or adhesive. Extending downward and substantially perpendicular from the sides of first portion 318 of collar 316 is a second portion, shown as sidewall 322. Sidewall 322 extends around the perimeter of collar 316.

Sidewall 316 includes a population of openings 324 extending through sidewall 322 proximate the corners of collar 316. Openings 324 are shown as slots arranged in columns. The slot openings 324 are shown as extending from the terminal end of sidewall 322 up toward first portion 318 of collar 316. In various embodiments, for example, openings 324 may be laser cut into sidewall 322. Openings 324 serve as side vents which permit airflow between a back volume (not shown) and the back volume side of a membrane 112. Openings 324 may be substantially aligned with the gaps between magnets 154 of magnet system 150 and thus a speaker may include a substantially clear air pathway between the back volume and the back volume side of membrane 112. Therefore, openings 324 permit an undistorted vibration of membrane 112 in response to the electrical signal fed into coil 132. With the inclusion of openings 324 on collar 316, back vents are not required in pot plate 180 as shown in FIG. 8B. By not requiring back vents on pot plate 180, the geometry and/or features of pot plate 180 can be simplified as compared to pot plate 80, thus reducing component cost. It will be understood however, that in various embodiments, in addition to or alternative to openings on collar 316, back vents may be provided on pot plate 180.

By use of the design shown in FIG. 9 furthermore the volume and the surface of the collar 316 is increased in comparison to the collar 116 of the speaker 110 shown in FIGS. 3 to 7. Accordingly, heat absorbing capability, heat radiation capability, heat transmission capability and heat storage capability is improved in comparison to the collar 116 of the speaker 110 shown in FIGS. 3 to 7.

Collar 316 further includes a stabilizing tab 326 extending substantially horizontally from sidewall 322. Stabilizing tab 326 functions the same as stabilizer tab 226 shown in FIG. 8A. Stabilizing tab 326 interfaces with flexible printed circuit 136, serves to stabilize flexible printed circuit 136, provides protection between the electrical connection between leads 134 and contact pads 138, and maintains the positions of collar 316 and coil assembly 130 in the speaker. Stabilizing tab 326 is affixed to flexible printed circuit 136 using an adhesive 142 (see FIG. 3), such as, for example, glue, tape, or other adhesives known in the art.

While embodiments of the audio transducer are shown and described as having a rectangular shape, it will be understood that in other embodiments, the audio transducer may have a variety of shapes, including, but not limited to, circular and ovular. Accordingly, the invention is not limited to audio transducers having a rectangular shape.

Moreover, it should be noted that the invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention. The scope of the present invention is defined by the appended claims, including known equivalents and unforeseeable equivalents at the time of filing of this application. Although numerous embodiments of this invention have been described above with a certain degree of particularity, those skilled in the art could make numerous alterations to the disclosed embodiments without departing from the spirit or scope of this disclosure.

In closing, it should be noted that any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The invention claimed is:

1. A membrane for a loudspeaker, wherein the membrane comprises:

a central portion comprising a sound emitting surface area and a back surface area located opposite the sound emitting surface area, wherein the sound emitting surface area and the back surface area of the central portion constitute at least 60 percent of the overall surface area of the membrane, wherein, the central portion is planar;

a first edge directly adjacent to the central portion and surrounding the central portion, wherein the first edge constitutes a boundary line between the central portion and an adjacent area comprising a different surface curvature than the central portion;

a second edge surrounding the first edge;

a clamping collar for mounting the membrane to the loudspeaker, wherein the second edge directly merges into the clamping collar;

an intermediate portion located between the first edge and the second edge, wherein the intermediate portion comprises at least one convex shaped section with regard to the sound emitting surface area of the central portion and at least one concave shaped section with regard to the sound emitting surface area of the central portion.

2. The membrane of claim 1, wherein an area of a top surface of the membrane lies within a range of 0.4 to 5 $cm^2$.

3. The membrane of claim 1, wherein a cross-section of the convex shaped section along a line normal to the first edge is of a U-shaped form and wherein a cross-section of the concave shaped section along a line normal to the first edge is of a U-shaped form.

4. The membrane of claim 1, wherein in a horizontal position of the central portion the concave shaped section is disposed above the central portion and the convex shaped section is disposed under the central portion.

5. The membrane of claim 1, wherein in a horizontal position of the central portion a distance between a level of a vertex of the convex shaped section and a level of the sound emitting surface is of the same absolute value as the distance between a vertex of the concave shaped section and the level of the sound emitting surface of the central portion.

6. The membrane of claim 1, wherein the central portion is disposed between the at least one concave shaped section and the at least one convex shaped section.

7. The membrane of claim 1, wherein the first edge and the second edge have the same shape.

8. The membrane of claim 7, wherein the shape of the first edge and the second edge is one of a conic section, a polygon and a tetragon.

9. The membrane of claim 1, wherein the at least one concave shaped section of the intermediate portion merges into the at least one convex shaped section of the intermediate portion or vice versa viewed in direction of a shortest distance between the first edge and the second edge.

10. The membrane of claim 1, wherein the first edge comprises:

a first and a second side running parallel to each other; and a third and a fourth side running parallel to each other, and wherein the second edge comprises:

a first and a second side running parallel to each other; and a third and a fourth side running parallel to each other, wherein the first side and the second side of the first edge run parallel to the first side and second side of the second edge, and the third side and the fourth side of the first edge run parallel to the third side and the fourth side of the second edge.

11. The membrane of claim 10, wherein the at least one convex shaped section is arranged between the first side of the first edge and the first side of the second edge and the at least one concave shaped section is arranged between the third side of the first edge and the third side of the second edge, said at least one convex shaped section connecting said first side of the first edge to said first side of the second edge and said at least one concave section connecting the third side of the first edge to the third side of the second edge.

12. The membrane of claim 11, wherein the first edge defines a tetragon with rounded corners, and wherein the second edge also defines a tetragon with rounded corners.

13. The membrane of claim 12, wherein the intermediate portion of the membrane comprises a Leporello fold shape within an area located between a rounded corner of the first edge and a rounded corner of the second edge and connecting said rounded corner of the first edge to said rounded corner of the second edge.

14. The membrane of claim 12, wherein a shape of the intermediate portion changes from a concave shape to a convex shape within an area located between a rounded corner of the first edge and a rounded corner of the second edge and connecting said rounded corner of the first edge to said rounded corner of the second edge.

15. The membrane of claim 12, wherein a shape of the intermediate portion changes from a convex-concave shape to a convex or concave shape within an area located between a rounded corner of the first edge and a rounded corner of the second edge and connecting said rounded corner of the first edge to said rounded corner of the second edge.

16. The membrane of claim 12, wherein a shape of the intermediate portion changes from a convex-concave shape to another convex-concave shape within an area located between a rounded corner of the first edge and a rounded corner of the second area and connecting said rounded corner of the first area to said rounded corner of the second edge.

17. The membrane according to claim 1, wherein the central portion is of a substantially rectangular shape with rounded corners.

18. A loudspeaker comprising a membrane, the membrane comprising:

a central portion comprising a sound emitting surface area and a back surface area located opposite the sound emitting surface area, wherein the sound emitting surface area and the back surface area of the central portion constitute at least 60 percent of the overall surface area of the membrane, wherein, the central portion is planar;

a first edge directly adjacent to the central portion and surrounding the central portion, wherein the first edge constitutes a boundary line between the central portion and an adjacent area comprising a different surface curvature than the central portion;

a second edge surrounding the first edge;

a clamping collar for mounting the membrane to the loudspeaker, wherein the second edge directly merges into the clamping collar;

an intermediate portion located between the first edge and the second edge, wherein the intermediate portion comprises at least one convex shaped section with regard to the sound emitting surface area of the central portion and at least one concave shaped section with regard to the sound emitting surface area of the central portion.

* * * * *